US012734575B2

(12) United States Patent
Ferraiolo

(10) Patent No.: US 12,734,575 B2
(45) Date of Patent: Sep. 15, 2026

(54) SENSOR-FITTED METAL NET

(71) Applicant: OFFICINE MACCAFERRI S.P.A., Zolda Predosa (IT)

(72) Inventor: Francesco Ferraiolo, Zola Predosa (IT)

(73) Assignee: OFFICINE MACCAFERRI S.p.A., Zola Predosa (IT)

( * ) Notice: Subject to any disclaimer, the term of this patent is extended or adjusted under 35 U.S.C. 154(b) by 11 days.

(21) Appl. No.: 17/041,627

(22) PCT Filed: Mar. 28, 2019

(86) PCT No.: PCT/IB2019/052534
§ 371 (c)(1),
(2) Date: Sep. 25, 2020

(87) PCT Pub. No.: WO2019/186447
PCT Pub. Date: Oct. 3, 2019

(65) Prior Publication Data

US 2021/0023605 A1 Jan. 28, 2021

(30) Foreign Application Priority Data

Mar. 28, 2018 (IT) ..... 102018000004022

(51) Int. Cl.
*B21F 27/00* (2006.01)
*B21F 27/08* (2006.01)
(Continued)

(52) U.S. Cl.
CPC ..... *B21F 27/005* (2013.01); *B21F 27/08* (2013.01); *E01F 7/045* (2013.01); *E02B 3/124* (2013.01); *E04H 17/02* (2013.01)

(58) Field of Classification Search
CPC ..... E04H 17/02; E04H 17/04; E04H 17/05; E04H 17/16; E04H 17/161; E02B 3/124;
(Continued)

(56) References Cited

U.S. PATENT DOCUMENTS 295,251 A * 3/1884 Hulbert ..... B21F 27/005 245/10
1,401,557 A * 12/1921 Riviere ..... B21F 27/06 140/6
(Continued)

FOREIGN PATENT DOCUMENTS

CN 208266894 U 12/2018
EP 1680552 B1 7/2006
(Continued)

OTHER PUBLICATIONS

International Search Report issued in corresponding International Application No. PCT/IB2019/052534 date of mailing Jul. 26, 2019 (3 pages).
(Continued)

*Primary Examiner* — Jonathan P Masinick
(74) *Attorney, Agent, or Firm* — FLYNN THIEL, P.C.

(57) ABSTRACT

A metal net having entwined metal wires defining the meshes of the metal net comprises at least one elongate sensor element fixed integrally to the metal net, inserted into the net during the production thereof. The elongate sensor element may comprise a wire of a material having a low coefficient of variation of the resistivity and a high gauge factor, preferably formed from constantan, or else may be of the optical fibre or composite fibre type.

26 Claims, 3 Drawing Sheets

(51) Int. Cl.
*E01F 7/04* (2006.01)
*E02B 3/12* (2006.01)
*E04H 17/02* (2006.01)

(58) Field of Classification Search
CPC ..... B21F 27/00; B21F 27/02; B21F 27/06; B21F 27/005; B21F 27/08; E01F 7/04; E01F 7/045
See application file for complete search history.

(56) References Cited

U.S. PATENT DOCUMENTS 1,491,364 A * 4/1924 William ..... E04H 17/04 245/8
1,859,831 A * 5/1932 Land ..... B21F 27/005 245/8
3,145,001 A * 8/1964 Bruninga ..... E04F 13/04 52/361
3,682,419 A * 8/1972 Vanderfaeillie ..... B21F 27/005 251/315.16
4,081,159 A * 3/1978 Baldwin ..... E04C 5/02 140/6
4,365,239 A * 12/1982 Mongeon ..... G08B 13/169 340/564
4,371,869 A * 2/1983 Davidson ..... G08B 13/186 340/557
4,558,308 A * 12/1985 Ciordinik ..... G08B 13/124 254/134.4
5,161,917 A * 11/1992 Papetti ..... E02D 29/0208 405/262
6,168,118 B1 * 1/2001 Vancraeynest ..... E01C 11/165 245/11
6,296,422 B1 * 10/2001 Ferraiolo ..... E02D 29/0241 405/262
9,002,153 B2 * 4/2015 Chun ..... G02B 6/4415 385/13
9,016,328 B2 * 4/2015 Ferraiolo ..... B21F 27/06 140/3 R
9,183,713 B2 * 11/2015 Doyle ..... G08B 13/22
9,469,955 B2 * 10/2016 Ferraiolo ..... E02B 3/108
10,767,330 B2 * 9/2020 Armanini ..... E02B 5/085
2004/0036063 A1 * 2/2004 Ferraiolo ..... E02D 29/0241 256/32
2006/0083458 A1 4/2006 Iffergan
2006/0131463 A1 6/2006 Jun et al.
2007/0079985 A1 4/2007 Ferraiolo
2012/0141214 A1 * 6/2012 Ferraiolo ..... A61F 13/49011 156/72
2021/0302268 A1 * 9/2021 Albertelli ..... G01L 1/127

FOREIGN PATENT DOCUMENTS

RU 41740 U1 11/2004
RU 79113 U1 12/2008
WO 2011030316 A1 3/2011
WO 2018146516 A1 8/2018

OTHER PUBLICATIONS

Written Opinion of International Searching Authority issued in corresponding International Application No. PCT/IB2019/052534 dated Jul. 26, 2019 (6 pages).
Russian Decision to Grant a Patent for Invention with English translation issued in corresponding Russian Patent Application No. 2020135050/05(064524) dated Jun. 22, 2023 (15 pages).

* cited by examiner

SENSOR-FITTED METAL NET

FIELD OF THE INVENTION

The present invention relates to the sector of interlaced metal nets. Nets of this type comprise, for example, double-twist hexagonal-mesh nets in which adjacent metal wires are interlaced with one another. Nets of this type are used for various civil protection works, for example as protection nets against rock falls, for constructing works in reinforced soil, for containing stone walls, riverbanks, roadbeds and trackbeds, and other works of this type.

TECHNOLOGICAL BACKGROUND

Metal nets, in particular of the double-twist type, have long been known and are used for innumerable civil protection and containment works. They may, for example, be used for containing escarpments, for producing mechanically stabilised earth, or for producing or reinforcing embankments. The nets may also be used for the same purposes in the form of gabions or mattress structures.

One of the basic requirements on nets of this type is to resist static forces or dynamic impacts of a predetermined magnitude. When the metal net is used as a net for protection for example from rock falls, and a significant impact event takes place, the metal net deforms and has to be replaced. However, if the forces or impacts are small in magnitude or if the deformation of the net is not permanent in nature, it is not usually possible to check visually to what extent and how frequently the metal net has been strained. Meanwhile, in works where the metal net is embedded in the ground, for example in the production of mechanically stabilised earth or green outer walls, it is not even possible to check potential permanent deformation of the net except through topographical inspection of the external wall.

In all these cases, the lack of information on the deformations undergone by the metal net in operation may bring about a risk of unexpected failure thereof, with sometimes serious consequences, for the avoidance of which it is necessary to schedule periodical inspections and planned repairs or replacements of the metal net. The frequency of the controls and repairs is a significant cost in the management of civil works.

In monitoring embankments and the banks of waterways, particular importance is placed on the possibility of keeping the saturation level of the embankments under control during flooding events and checking the presence of discontinuities created for example by burrowing animals. For this purpose, techniques are known which provide extension of geoelectric material, parallel to the waterway and completely separate from the materials used for protecting the embankments or banks.

The present invention aims to resolve the problems of the prior art and to provide a simple and effective system for monitoring the state of civil works which use interlaced metal nets. Another object is to provide a metal net the state of which can be monitored directly, preferably continuously, in normal use. Another object is to produce a metal net in which the monitoring of the strain state thereof is effective, relatively cheap, and simple to implement.

SUMMARY OF THE INVENTION

To achieve the aforementioned objects, the invention relates to a metal net with elongate sensor elements fixed integrally to the net.

In particular, the elongate sensor elements can detect variations in one or more parameters, for example temperature and/or deformation. Alternatively or in addition, they can detect the presence of vibrations and/or the humidity level and/or variations in pressure, electrical field, magnetic field etc.

The elongate sensor elements are integral with the net. More specifically, the elements which form the net, and in particular the metal wires, and the elongate sensor elements, which are for detecting the deformations or which are part of the geoelectric detection system, are integral with one another, in the sense that the sensor elements are inserted into the net during the production thereof. Even more specifically, the elongate sensor elements are incorporated into the meshes of the metal net. For example, the sensor elements are inserted selectively into the nodes of the meshes in the longitudinal direction of the net and/or in the transverse direction of the net. The elongate sensors may be added to the wires with which the metal mesh is produced, so as to construct three-wire nodes, or may be substituted for the wires to produce two-wire nodes at the interlacings with the adjacent metal wires. Depending on the type of strain to which the elongate sensor elements are responding, they may be incorporated into the meshes of the metal net along a substantially rectilinear path or in a wavier path with loops.

The fact that the sensor is incorporated into the metal meshes of the net causes the net itself to be the means by which the surrounding environment comes into contact with the sensors; the metal net, which is often completely embedded in a structure (reinforced earth, an embankment etc.), undergoes all the deformations and vibrations to which the structure in which it is embedded is subjected. It can thus transmit this information to the sensors with optimum effectiveness and sensitivity.

The net comprising the sensors can be used to produce an alarm system, which sends a signal when, after some event, a predetermined threshold for a parameter is exceeded. For example, it may send an alarm signal when a deviation in temperature or a deformation above a threshold considered acceptable is detected, or a vibration of an amplitude or frequency considered dangerous is detected.

The net comprising fixed, elongate sensor elements fixed integrally to the net itself may also be used to implement systems for monitoring a building work, which keep specified parameters, describing the state of health and state of use of the work, under continuous monitoring. The sampling frequency may be very high.

Naturally, the metal net comprising the elongate sensor elements maintains all of the properties of the net free of elements of this type, including resistance. It thus maintains all of the properties of the prior art net which make it a suitable reinforcement element in a wide variety of building works, whilst also bringing a new, important function of monitoring the conditions of the net itself, without the need to implement another separate element. Further, since the sensors are incorporated into the net itself, the monitoring is more sensitive than that which would be obtained using sensors separate from the net. In this regard, the second aspect, according to which the sensor elements are inserted into the nodes of the metal net, is particularly beneficial; this guarantees that the sensor elements cannot slide relative to the net. The elongate sensors may comprise different materials in relation to the type of measurement or detection which it is intended to carry out. In the case of evaluating deformations for example, one or more sensor wires may be used, made of a material having a low coefficient of variation of resistivity, in such a way that the variation in resistance when the temperature varies is very small. These sensor wires are integrated into the metal net so as to have a substantially rectilinear path, and preferably have a high extensometer factor (gauge factor) capable of showing a relatively high variation in resistance when the deformation which they undergo varies. A preferred material for producing elongate sensors of this type is constantan or a material having similar features, for example the copper-manganese nickel alloy known by the trade name "manganin", the copper-zinc-nickel alloy known as "nickel brass", and the alloy of nickel and chromium known as "nichrome". To avoid short circuits with the metal wires in the net, or with the surrounding environment, the elongate sensors can be covered with a layer or sheath of insulating material.

For some applications, it is also possible to use elongate sensors of the composite fibre and/or optical fibre type, for example Bragg reticule sensors. Some sensors of this type make it possible to acquire information regarding localised deformation, including at predetermined intervals along the longitudinal extension of the sensor, in accordance with the construction technology of the optical fibre or composite fibre sensor.

The invention thus provides the possibility of interlacing these elongate sensor elements in a, for example double-twist, metal net during the production process of the metal net itself.

In a particularly beneficial aspect, the sensor elements are optical fibres, and preferably optical fibre sensors based on scattering phenomena. In particular, the applicant has identified an ideal sensor in optical fibre sensors which use the Brillouin effect. Brillouin scattering, as is known, brings about variation in the light frequency, caused for example by the presence of local deformation or of a variation in temperature. By analysing the light detected at the output of the fibre, it is thus possible to reconstruct the presence of local deformations or variations in temperature.

These sensors thus make it possible to detect, along a particular stretch of a single optical fibre, both variations in temperature and deformations, whilst maintaining an optimal spatial resolution, for example on the order of 1 metre over a total length of up to 100 km, if OTDR (optical time domain reflectometry) is used, or 1 cm over a total length of up to 10 km if BOCDA (Brillouin optical correlation domain analysis) is used. They are also economical, and can even be used over very long lengths in the order of kilometres.

An example of a fibre which can be used in a Brillouin effect sensor is a "telecom grade" optical fibre, in other words one of the type used for telecommunications. The fibre has a standard diameter of 125 microns. It is produced using pure siliceous material in the amorphous state, in other words in pure glass. The glass is enclosed in a protective coating.

However, the use of optical fibre sensors based on different scattering phenomena (for example Raman or Rayleigh), or other interferometric optical fibre sensors, is not excluded. It is further possible to provide distinct temperature and deformation sensors, even though detection of variations in temperature and of deformations by way of a single sensor is preferred for economic reasons and reasons of simplicity of implementation. Vibration, pressure, electric and/or magnetic field sensors etc. may further be provided.

A metal net comprising elongate sensor elements fixed integrally to the net is of use in various applications. It can be buried to produce reinforced soil, or more generally to produce support works. It can be inserted into the interior of a roadbed or a road superstructure, bound (for example bituminous) or otherwise. In all these cases, it is particularly beneficial to be able to be aware of any local deformations which may be completely invisible from the outside but may be equally dangerous for the endurance of the structure. The present invention therefore also relates to a reinforced soil or a roadbed or a road superstructure comprising a net comprising elongate sensor elements fixed integrally to the net, having some or all of the additional features described above and hereinafter.

The net may also be used as a rock protection barrier or bonded rock protection net. In this case, a local deformation might be visible to the naked eye, but inspection might not be easy as a result of difficulty of access to the site. In any case, between one inspection and the next, events could take place which deform or even break the structure and of which it is advisable to be informed in a timely manner. The present invention therefore also relates to a rock protection barrier comprising a net comprising elongate sensor elements fixed integrally to the net, having some or all of the additional features described above and hereinafter.

The present invention further relates to a road or railway embankment comprising a net comprising elongate sensor elements fixed integrally to the net, having some or all of the additional features described above and hereinafter. The net may also be positioned either at the base or in intermediate positions in the embankment, including in the case of embankments on poles.

The invention comprises a net for producing escarpments and capping in a landfill, comprising elongate sensor elements fixed integrally to the net, having some or all of the additional features described above and hereinafter. In a landfill too, it is actually extremely useful to be able to have immediate feedback both in the case of structural deformations of the escarpments of the container or capping and in the case of variations in temperature, which could be due to a loss.

The invention further comprises a river bank, canal, lake or more generally water basin, or else a dam, comprising a net comprising elongate sensor elements fixed integrally to the net, having some or all of the additional features described above or hereinafter. Indeed, in the case of banks and dams it is obviously very important to have immediate feedback in the case of even a small deformation of the structure, since it could cause weakening and subsequently a break, with potentially catastrophic effects, both as a result of the flooding which inevitably follows and as a result of the difficulty in repairing a bank which has previously given way. The timeliness of the intervention is fundamental to avoiding the breaking of a bank, and thus constant, precise and punctual monitoring is of extremely great importance. In the preferred case, where the net comprises at least one elongate temperature and deformation sensor element, it is also possible to monitor the temperature, which may indicate the presence of a loss. Even a small loss, which has not yet necessarily caused a deformation in the structure of the bank itself, may nevertheless be problematic, and it is thus preferable for it to be reported. In the production of banks, the possibility of monitoring even a very long stretch with contained costs and high precision is of particular importance. Preferably, the sensor is an optical fibre sensor, and even more preferably an optical fibre sensor which makes use of the Brillouin effect.

The invention further comprises a cover structure for pipes, comprising a net comprising elongate sensor elements fixed integrally to the net, having some or all of the features described above and hereinafter. The pipes may be for gas or petroleum, or else for water, for example in the case of aqueducts or penstocks of hydroelectric plants.

In all the applications described above, and in others, the net may comprise at least one elongate temperature and deformation sensor element. For reasons of cost and of precision and reliability, the elongate sensors are preferably optical fibres, even more preferably optical fibre sensors which make use of the Brillouin effect.

BRIEF DESCRIPTION OF THE DRAWINGS

Further features and advantages will be apparent from the following detailed description of preferred embodiments, referring to the accompanying drawings, given by way of non-limiting example, in which.

DETAILED DESCRIPTION

Figure 1:
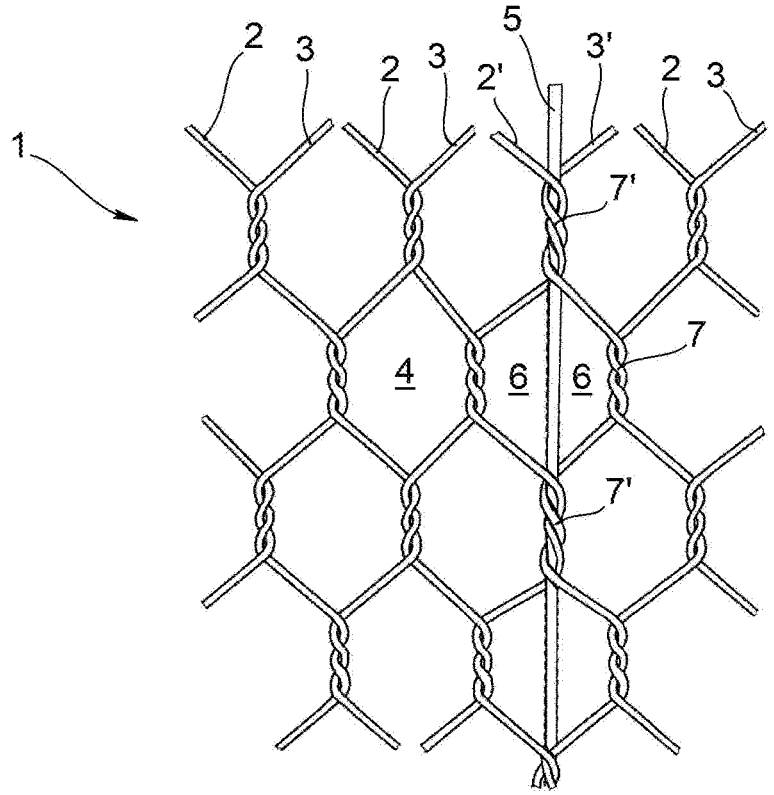
FIG. 1 is a view of an example of a portion of hexagonal-mesh net incorporating aspects of the present invention.
Figure 3:
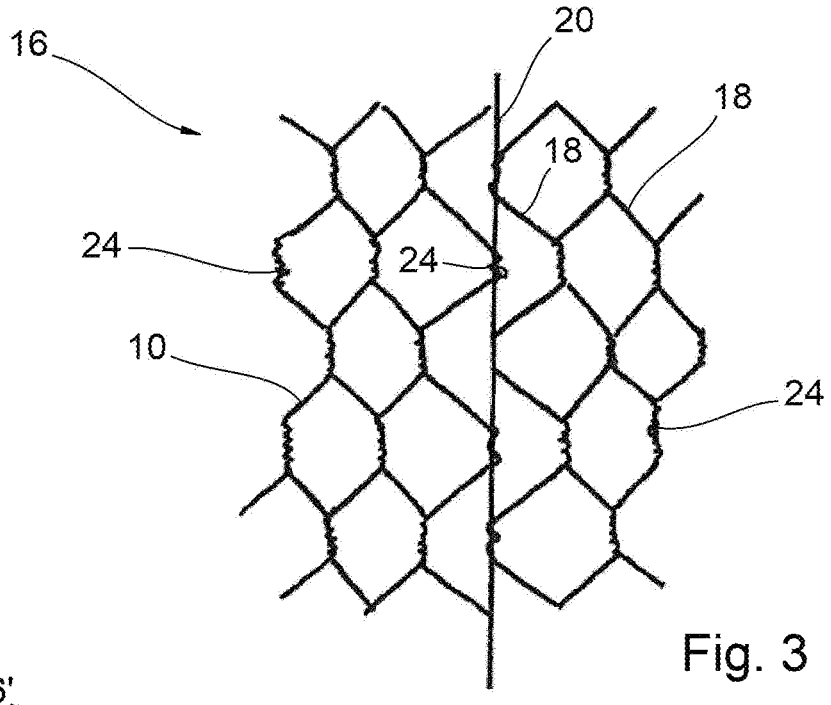
FIG. 3 is a view of a third example of a portion of hexagonal-mesh net incorporating aspects of the present invention.

Referring now to FIG. 1, an example is shown of a portion of preferably hexagonal-mesh net incorporating aspects of the present invention. The net 1 may be a double-twist hexagonal-mesh net, which may comprise a plurality of wires 2, 3, 2', 3', in particular metal wires, preferably made of steel, entwined around one another in twisted portions 7, 7' to form hexagonal meshes 4. The twisting follows a single twisting direction in each twisted portion 7, 7': clockwise or anticlockwise but constant in each twisted portion. In FIG. 3, the twisted portions 7, 7' have the wires 2, 3 entwined in an alternating direction between one row and the next: if the wires 2 and 3 are entwined with one another clockwise in one row, the wires 2 and 3 are entwined anticlockwise in the row below and the row above. However, a variant in which all the twisted portions 7, 7' have a single entwinement direction is not to be excluded.

The net 1 may comprise at least one elongate sensor 5 inserted longitudinally through selected twisted portions 7'. The elongate sensor 5 may form two trapezoid meshes 6 flanked by two successive twisted portions 7' in a longitudinal direction defined by the direction along which the elongate sensor 5 extends. The elongate sensor is preferably a wire of an alloy for extensometers, for example constantan—an alloy of copper and nickel—or any other known metal alloy having good sensitivity to deformation (gauge factor) and a relatively low sensitivity to the amplitude of the deformation and to temperature. For this purpose, other known alloys having similar features may be used, for example the copper-manganese-nickel alloy known by the trade name "manganin", the copper-zinc-nickel alloy known as "nickel brass", and the alloy of nickel and chromium known as "nichrome". The elongate sensor 5 may be covered with a layer or sheath of insulating material. In some applications, it is also possible to use an optical fibre or composite fibre elongate sensor.

At the heads of the elongate sensor 5, with variable spacing, a known data acquisition system is provided comprising an electronic device which detects, in the case of the use for example of a constantan wire, the electrical potential at the heads of the elongate sensor 5, and is capable of reporting and/or storing a variation in said electrical potential.

In the case of the use of optical fibres or composite fibres, an equivalent data acquisition system in the use of these fibres is provided in the installation step on a building site, in a spacing which is variable as a function of the subdivisions in individual homogeneous stretches to be monitored. The system normally provides at least one light source and a photodetector.

Figure 2:
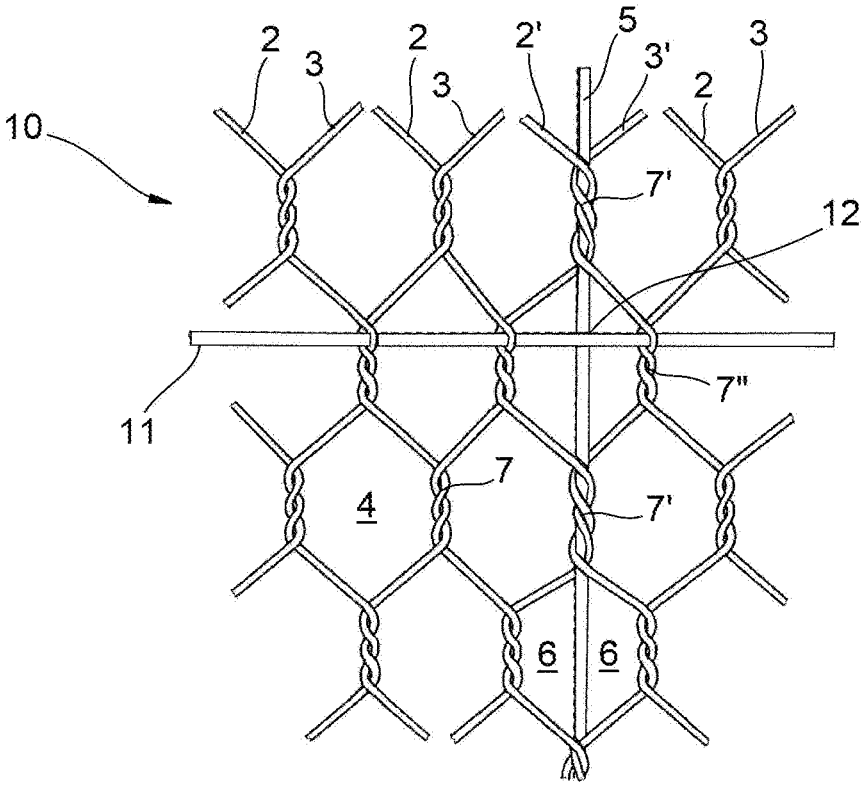
FIG. 2 is a view of a second example of a portion of hexagonal-mesh net incorporating aspects of the present invention.

Referring now to FIG. 2, another example is shown of a portion of hexagonal-mesh net incorporating aspects of the present invention. In the variant of FIG. 2, the net 10 further comprises at least one transverse elongate sensor 11. The transverse elongate sensor 11 is arranged perpendicular to the elongate sensors 5, which are intersected by the transverse elongate sensor 11 at intersections 12. The at least one transverse elongate sensor 11 is inserted into the interior of twisted portions 7" formed by only two longitudinal wires 2, 3, 2', 3'. The at least one transverse elongate sensor 11 is also preferably a wire of an alloy for extensometers, for example constantan—an alloy of copper and nickel—or any other known metal alloy having good sensitivity to deformation (gauge factor) and a relatively low sensitivity to the amplitude of the deformation and to temperature. For this purpose, other known alloys having similar features may be used, for example the copper-manganese-nickel alloy known by the trade name "manganin", the copper-zinc-nickel alloy known as "nickel brass", and the alloy of nickel and chromium known as "nichrome". The transverse elongate sensor 11 may be covered with a layer or sheath of insulating material. In some applications, it is also possible to use an optical fibre or composite fibre elongate sensor. The transverse elongate sensor 11 may be of the same type as or a different type from the elongate sensor 5. At the heads of the transverse elongate sensor 11, a known electronic circuit is provided, which detects, in the case of the use of constantan or the like, the electrical potential at the heads of the transverse elongate sensor 11, and is capable of reporting and/or storing a variation in this electrical potential. The electronic circuit may be combined with the electronic circuit which detects the potential difference in the elongate sensor 5, or else may be a different electronic circuit.

It should be noted that the net portions depicted in FIGS. 1 and 2 exhibit a single longitudinal elongate sensor 5 and a single transverse elongate sensor 11 because the portion of the net 1 depicted in the drawings is small so as to make it possible to appreciate the details thereof. However, a plurality of longitudinal and transverse elongate sensors may normally be provided. A net having these features is capable of reporting, by way of a the electronic circuit or circuits arranged at the heads of each longitudinal 5 and/or transverse 11 elongate sensor, deformation events caused for example by a load or impact on the net, or else of being used as a structure forming a monitoring system linked to an element having its own mechanical resistance features, such as a metal net.

A net 1 as described above with reference to FIG. 1 or 2 may be produced by way of a machine of the type forming the subject matter of international patent application no. PCT/IB2017/050700, by the same applicant. It should be noted that the machine described in said patent application does not place any limits on the length of the sensor 5. Indeed, the machine feeds the element 5 directly from a bobbin, which does not have size limitations imposed by the machine or by the manufacturing process. This aspect is particularly beneficial in the case where the sensor is an optical fibre, since it is preferable to reduce the number of junctions as much as possible.

Referring to FIG. 3, another example is shown of a portion of hexagonal-mesh net 16 incorporating aspects of the present invention. In this case, the net 16 is formed by wires 18 entwined together at the nodes 24 so as to form hexagonal meshes. At selected intervals, an elongate sensor 20, which extends longitudinally to form trapezoidal meshes with the adjacent wires 18 to which it is entwined at the nodes 24, is substituted in place of one of the wires 18. As described above in relation to the examples of FIGS. 1 and 2, the at least one elongate longitudinal sensor 20 is preferably a wire of an alloy for extensometers, for example constantan—an alloy of copper and nickel—or any other known metal alloy having good sensitivity to deformation (gauge factor) and a relatively low sensitivity to the amplitude of the deformation and to temperature. For this purpose, other known alloys having similar features may be used, for example the copper-manganese-nickel alloy known by the trade name "manganin", the copper-zinc-nickel alloy known as "nickel brass", and the alloy of nickel and chromium known as "nichrome". The elongate longitudinal sensor 20 may be covered with a layer or sheath of insulating material. In some applications, it is also possible to use an optical fibre or composite fibre elongate sensor. At the heads of the longitudinal elongate sensor 20, a known electronic circuit is provided, which detects the electrical potential at the heads of the longitudinal elongate sensor 20, and is capable of reporting and/or storing a variation in this electrical potential. In the case where the elongate sensor 20 is of the optical fibre or composite fibre type, another data acquisition system is provided at the heads thereof, generally comprising at least one light source and at least one photodetector.

Figure 4:
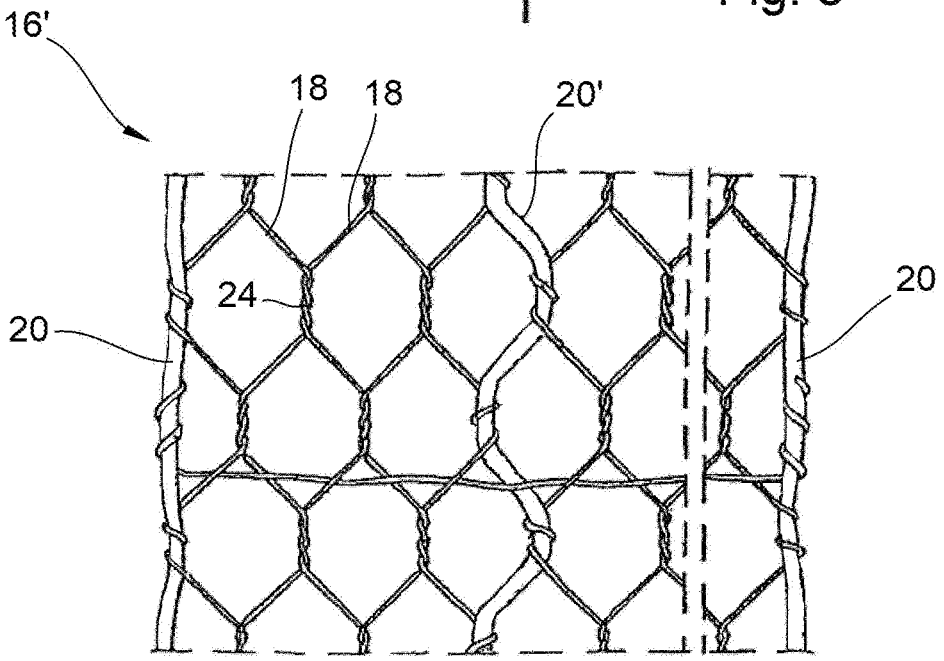
FIG. 4 is a view of a fourth example of a portion of hexagonal-mesh net incorporating aspects of the present invention.

In FIG. 4, another example is shown of a portion of hexagonal-mesh net 16 incorporating aspects of the present invention. In this case, the net is formed by the wires 18 entwined together at the nodes 24 so as to form hexagonal meshes. At selected intervals, an elongate sensor 20', which extends longitudinally to form trapezoidal meshes with the adjacent wires 18 to which it is entwined at the nodes 24, is substituted in place of one of the wires 18. By comparison with FIG. 3, where the elongate sensor 20 is substantially rectilinear, in the example of FIG. 4, the elongate sensor 20' is arranged so as to form curved loops. In a single net, it is possible also to use elongate sensors 20 arranged substantially rectilinearly as well as sensors 20' arranged in a loop, as is shown by way of non-limiting example at the edges of the net in FIG. 4.

A net as described above with reference to FIGS. 3 and 4 may be produced by way of a machine described in document WO 2011/030316 by the same applicant.

Figure 5:
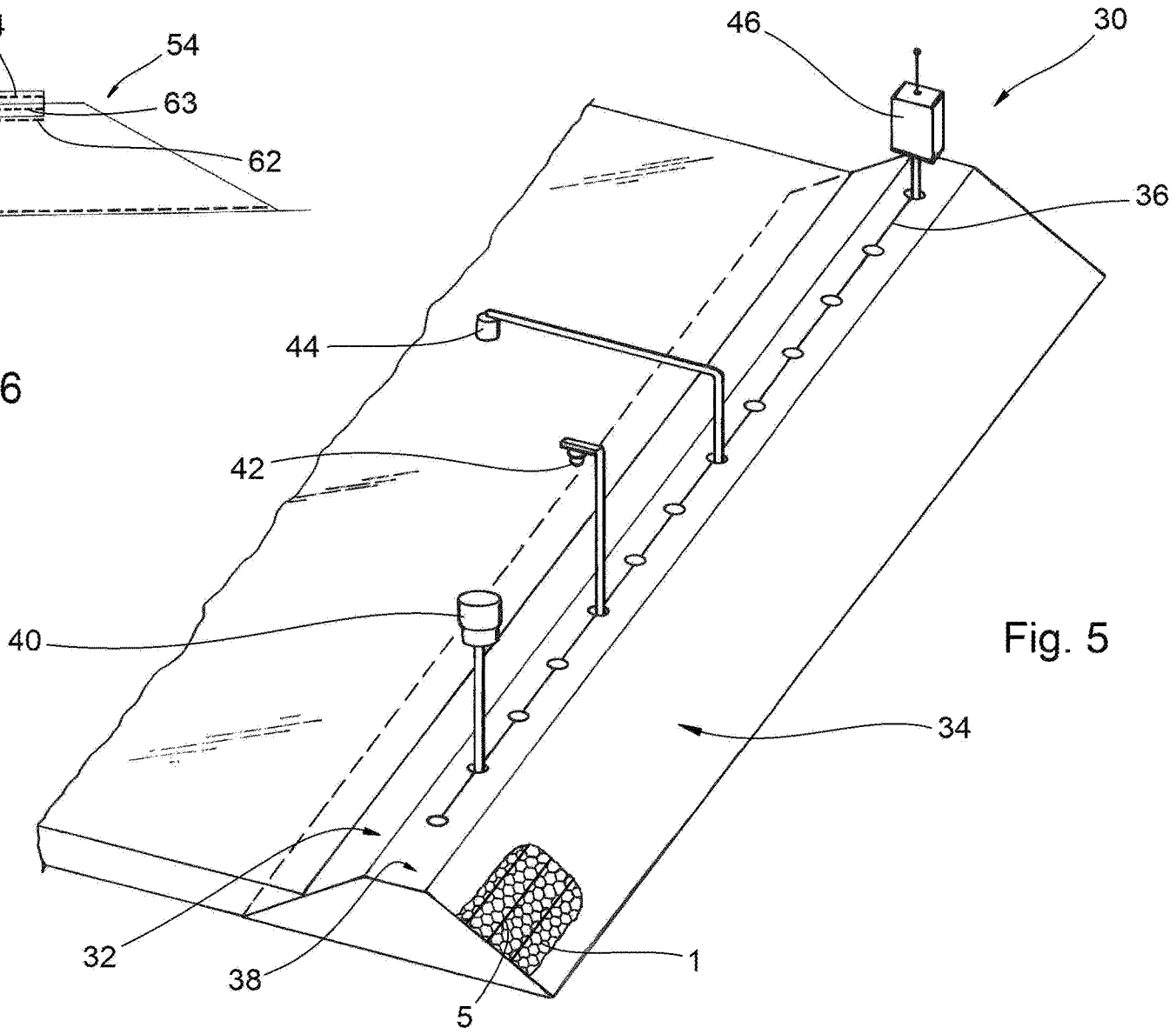
FIG. 5 is a view of a bank of a river reinforced with a hexagonal-mesh net incorporating aspects of the present invention.

Referring now to FIG. 5, a net having incorporated elongate sensors may be used for producing a bank 30 of a river, a canal, a lake or the like. In particular, a net 1 as described above with reference to FIG. 1 may be used, optionally also folded so as to form a mattress structure. Naturally, it is also possible to use a net 10, 16, 16' like those of FIG. 2, 3 or 4, or having features combined from among those of the four described types of net.

In a known manner, the bank 30 comprises an embankment having two flanks 32 and 34: an inner flank 32, facing towards the water, and an outer flank 34, facing the opposite side. The net 1 may be used to reinforce only one of the flanks 32, 34 or both. For this purpose, it is placed on the previously compacted ground. Subsequently, it may also be covered, for example with soil, as in the example case of FIG. 5.

The net 1 is placed on the ground with the elongate sensor elements 5 preferably arranged parallel to the direction of the river or parallel to the shore, in the case of a water basin, or in other words parallel to a primary direction of the bank itself. In this way, a single sensor element monitors long stretches of the bank 30. The bank further comprises a communication backbone 36, preferably positioned on the summit 38 of the bank.

The bank 30 may further comprise a rain sensor 40, which is particularly beneficial in the case where at least one of the two elongate sensors 5 detects humidity or temperature. Indeed, it is clear that in the case of rain an increase in humidity and probably also a variation in temperature, which however are not attributable to a loss of the bank, will be detected. The possibility of monitoring the presence of rainwater thus makes it possible to interpret correctly the values detected by the sensors 5.

The bank 30 may also comprise a hydrometer 44, to monitor the height of the water. It may also comprise a surveillance video camera 42. The communication backbone 36 transmits the information received from all of the equipment, as well as the signals detected by detection control units 46, positioned a predetermined distance apart. The detection control units 46 may comprise a data acquisition system for acquiring the signal from the elongate sensor elements 5.

In use, the elongate sensors 5 monitor at least one parameter, for example deformation, temperature, humidity and vibration. It should be noted in particular that the fact that the sensors 5 are fixed at the nodes 7' of the net 1 causes the net itself to be the means by which the surrounding environment comes into contact with the sensors 5. The metal net 1, which in the illustrated example is completely embedded in the bank, undergoes all the deformations and vibrations to which the structure in which it is embedded is subjected, and therefore transmits them highly efficiently to the sensors.

The bank 30 is thus an intrinsically monitored bank. Naturally, the type of monitoring may be modified depending on the requirements of the particular stretch and on multiple variables, such as the atmospheric conditions, the detected height of the water etc. For example, it is possible to vary the sampling frequency, but also to set different alarm thresholds for each monitored parameter.

It should be emphasised that the net 1 maintains the functions of a conventional metal net for erosion control and for reducing the risks associated with the presence of burrowing animals. Further, the net 1, being provided with elongate sensors 5, also performs a further function of hydraulic and geotechnical monitoring.

For producing the bank 30 of FIG. 5, the use of optical fibres sensors 5 is particularly recommended, and in particular optical fibres based on scattering phenomena are preferable. The preferred choice is the use of optical fibres which use the Brillouin effect, because they are well suited to monitoring very long stretches effectively and precisely, as is indeed the case for banks of rivers, canals or lakes, which typically extend for many kilometres.

Figure 6:
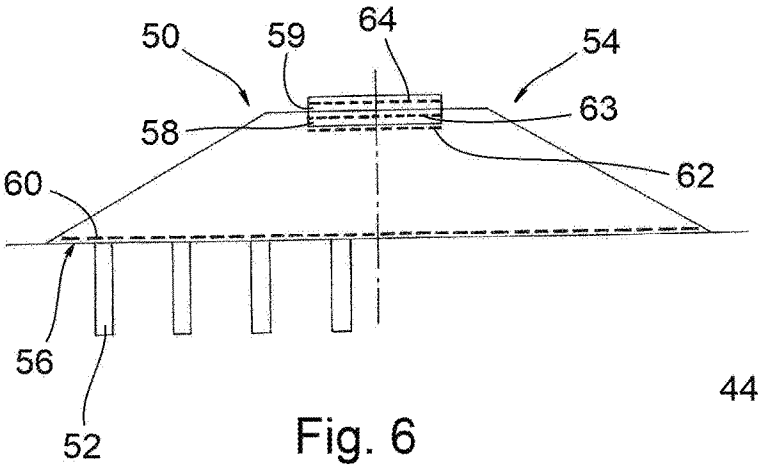
FIG. 6 is a view of a reinforced road embankment comprising a hexagonal-mesh net incorporating aspects of the present invention.

Referring now to FIG. 6, a net having incorporated elongate sensors may be used for producing a road or railway embankment. In the drawings, the example of a road embankment 50 on poles and a road embankment 54 free of poles is shown. Independently of the presence or otherwise of poles 52, the road embankment 50, 54 comprises at least one net having elongate sensors.

A first net 60 comprising elongate sensor elements is positioned at the base 56 of the road embankment 50, 54. A second net 62 comprising elongate sensor elements is positioned at the base of the foundation 58. A third net 63 comprising elongate sensor elements is positioned in the interior of the foundation 58, which may be bound or unbound. A fourth net 64 comprising elongate sensor elements is positioned in the interior of the road pavement 59, which may optionally comprise bituminous macadam. In the examples illustrated, both of the road embankments 50 and 54 comprise four nets 60, 62, 63, 64, comprising elongate sensors, even though it is naturally possible to use one net comprising elongate sensors in only one of the described positions, using nets free of elongate sensors in the other positions or alternative reinforcement structures.

Naturally, without prejudice to the principle of the invention, the embodiments and the implementation details may vary considerably from what is described and illustrated, without departing from the scope of the present invention as a result.

The invention claimed is:

1. A metal net having a longitudinal direction and a transverse direction oriented transversely to the longitudinal direction, the metal net comprising:

a plurality of elongate metal wires oriented lengthwise along the longitudinal direction of the metal net; and at least one elongate sensor element oriented lengthwise along the longitudinal direction of the metal net;

the at least one elongate sensor element being fixed to and integrated with one or more of the elongate metal wires at connection nodes;

the connection nodes being spaced from one another along at least the longitudinal direction of the metal net;

each connection node comprising one of:

a three-component connection node including two entwined portions of two adjacent ones of the elongate metal wires and part of the at least one elongate sensor element inserted into and extending through the two entwined portions; or a two-component connection node including a portion of one of the elongate metal wires entwined with part of the at least one elongate sensor element; and wherein the at least one elongate sensor element is configured to detect one or more of the following parameters: temperature variations in an environment surrounding the metal net; permanent deformation of the metal net; vibration in an environment surrounding the metal net; humidity level in an environment surrounding the metal net; pressure in an environment surrounding the metal net; electrical field in an environment surrounding the metal net; and/or magnetic field in an environment surrounding the metal net.

2. The metal net according to claim 1, wherein the at least one elongate sensor element is a first elongate sensor element and the metal net further comprises a second elongate sensor element oriented transversely to the first elongate sensor element, the second elongate sensor element extending lengthwise along the transverse direction of the metal net.

3. The metal net according to claim 1, wherein the at least one elongate sensor element has a substantially rectilinear path along the metal net or a wave-shaped path along the metal net.

4. The metal net according to claim 1, wherein the at least one elongate sensor element comprises a substantially rectilinear wire.

5. The metal net according to claim 1, wherein the at least one elongate sensor element is covered with a layer or sheath of insulating material.

6. The metal net according to claim 1, wherein the at least one elongate sensor element comprises an optical fiber sensor or a composite fiber sensor.

7. The metal net according to claim 1, wherein the elongate metal wires and the at least one elongate sensor element have respective longitudinal dimensions oriented substantially along the longitudinal direction of the metal net.

8. The metal net according to claim 1, wherein each connection node comprises the three-component connection node, and the at least one elongate sensor element is inserted into and extends through the two entwined portions of each three-component connection node and linearly along the longitudinal direction of the metal net.

9. The metal net according to claim 8, wherein two of the elongate metal wires are disposed transversely adjacent one another and the at least one elongate sensor element is disposed between the two transversely adjacent elongate metal wires, the three-component connection nodes being spaced from one another along the longitudinal direction of the metal net and each being formed from part of the at least one elongate sensor element and portions of the same two transversely adjacent elongate metal wires.

10. The metal net according to claim 1, wherein each connection node comprises the two-component connection node.

11. The metal net according to claim 10, wherein two of the elongate metal wires are disposed transversely adjacent one another, and the at least one elongate sensor element is disposed between the two transversely adjacent elongate metal wires and interconnects the two transversely adjacent ones of the elongate metal wires to one another.

12. The metal net according to claim 11, wherein first ones of the two-component connection nodes are each formed from part of the at least one elongate sensor element and a portion of one of the two transversely adjacent elongate metal wires, and second ones of the two-component connection nodes are each formed from another part of the at least one elongate sensor element and a portion of the other of the two transversely adjacent elongate metal wires, the first and second ones of the two-component connection nodes being disposed in an alternating manner with one another along the longitudinal direction of the metal net.

13. The metal net according to claim 1, wherein the elongate metal wires are entwined with one another and together form additional two-component connection nodes, each additional two-component connection node including two entwined portions of adjacent ones of the elongate metal wires.

14. The metal net according to claim 1, wherein each of the elongate metal wires and the at least one elongate sensor element has a width and a length greater than the width, and each of the elongate metal wires and the at least one elongate sensor element extend lengthwise along the longitudinal direction of the metal net.

15. The metal net according to claim 1, wherein the elongate metal wires and the at least one elongate sensor element extend in an undulating manner along the longitudinal direction of the metal net.

16. The metal net according to claim 1, wherein the elongate metal wires extend in an undulating manner along the longitudinal direction of the metal net, and the at least one elongate sensor element extends linearly along the longitudinal direction of the metal net.

17. The metal net according to claim 1, wherein:

the at least one elongate sensor element receives a signal indicating the one or more parameters are detected.

18. A monitored bank for containing a waterway or basin, comprising an embankment with two flanks, a metal net according to claim 1 being embedded in at least one of the two flanks.

19. The monitored bank according to claim 18, wherein the at least one elongate sensor element is arranged parallel to a primary direction of the bank itself.

20. A road or railway embankment comprising a foundation and a road or railway pavement, comprising at least one metal net according to claim 1.

21. The road or railway embankment according to claim 20, wherein the at least one metal net is positioned in one or more of the following positions:

at a base of the road embankment;

at a base of the foundation;

in an interior of the foundation; and/or in an interior of the railway pavement.

22. A process for manufacturing a metal net according to claim 1, wherein the at least one elongate sensor element is inserted into the metal net during production thereof.

23. A metal net having a longitudinal direction and a transverse direction oriented transversely to the longitudinal direction, said metal net comprising:

a plurality of elongate metal wires;

a plurality of first nodes disposed at spaced intervals from one another along said metal net, each said first node comprising entwined portions of adjacent ones of said elongate metal wires;

at least one elongate sensor element fixed to said metal net; and a plurality of second nodes disposed in spaced-apart relation from one another along at least the longitudinal direction of said metal net, each said second node comprising one of: a three-component node including entwined portions of two adjacent ones of said elongate metal wires and a portion of said at least one elongate sensor element fixedly engaged therewith and extending through the entwined portions; or a two-component node including a portion of one of said elongate metal wires entwined with a portion of said at least one elongate sensor element, said first and second nodes being distributed along said metal net to provide said metal net with a mesh configuration, and said elongate metal wires and said at least one elongate sensor element are all oriented lengthwise along the longitudinal direction of said metal net;

wherein the at least one elongate sensor element is configured to detect one or more of the following parameters: temperature variations in an environment surrounding the metal net; permanent deformation of the metal net; vibration in an environment surrounding the metal net; humidity level in an environment surrounding the metal net; pressure in an environment surrounding the metal net; electrical field in an environment surrounding the metal net; and/or magnetic field in an environment surrounding the metal net.

24. The metal net according to claim 23, wherein:

the at least one elongate sensor element receives a signal indicating the one or more parameters are detected.

25. A metal net having a longitudinal direction and a transverse direction oriented transversely to the longitudinal direction, the metal net comprising:

a plurality of elongate metal wires oriented lengthwise along the longitudinal direction of the metal net; and elongate sensor elements oriented lengthwise along the longitudinal direction of the metal net;

the elongate sensor elements being fixed to and integrated with one or more of the elongate metal wires at connection nodes such that the elongate sensor elements cannot slide relative to the connection nodes in which each of the elongate sensor elements is fixed to and integrated with;

the connection nodes being spaced from one another along at least the longitudinal direction of the metal net;

each connection node comprising one of:

a three-component connection node including two entwined portions of two adjacent ones of the elongate metal wires and part of the elongate sensor elements inserted into and extending through the two entwined portions; or a two-component connection node including a portion of one of the elongate metal wires entwined with part of the elongate sensor elements;

wherein the elongate sensor elements are configured to detect one or more of the following parameters:

temperature variations in an environment surrounding the metal net; permanent deformation of the metal net;

vibration in an environment surrounding the metal net;

humidity level in an environment surrounding the metal net;

pressure in an environment surrounding the metal net;

electrical field in an environment surrounding the metal net; and/or magnetic field in an environment surrounding the metal net.

26. The metal net according to claim 25, wherein:

the elongate sensor elements receive a signal indicating the one or more parameters are detected.

* * * * *